US005359145A

United States Patent [19]

Okamura

[11] Patent Number: 5,359,145

[45] Date of Patent: Oct. 25, 1994

[54] TIME-DIVISIONAL DATA REGISTER

[75] Inventor: Kazuhisa Okamura, Hamamatsu, Japan

[73] Assignee: Yamaha Corporation, Hamamatsu, Japan

[21] Appl. No.: 64,747

[22] Filed: May 18, 1993

Related U.S. Application Data

[63] Continuation of Ser. No. 748,103, Aug. 21, 1991.

[30] Foreign Application Priority Data

Aug. 27, 1990 [JP] Japan ..... 2-222546

[51] Int. Cl.[5] ..... G10H 1/18

[52] U.S. Cl. ..... 84/602; 84/645

[58] Field of Search ..... 84/602, 604, 605, 617, 84/645, 655

[56] References Cited

U.S. PATENT DOCUMENTS

| | | | |
|---|---|---|---|
| 4,539,883 | 9/1985 | Chihana | 84/617 |
| 4,633,749 | 1/1987 | Fujimori et al. | 84/607 |
| 4,719,833 | 1/1988 | Katoh et al. | 364/418 X |
| 4,777,857 | 10/1988 | Stewart | 84/645 |
| 4,872,385 | 10/1989 | Oguri et al. | 84/635 |
| 4,998,960 | 3/1991 | Rose et al. | 84/622 |
| 5,007,323 | 4/1991 | Usami | 84/607 |
| 5,107,747 | 4/1992 | Saito | 84/655 |
| 5,127,303 | 7/1992 | Tsumura et al. | 84/609 |
| 5,136,912 | 8/1992 | Morikawa et al. | 84/603 |
| 5,214,229 | 5/1993 | Mizuno | 84/615 |

*Primary Examiner*—William M. Shoop, Jr.
*Assistant Examiner*—Brian Sircus
*Attorney, Agent, or Firm*—Spensley Horn Jubas & Lubitz

[57] ABSTRACT

A time-divisional data register comprises a shift register and a latch and is used for transferring data from a first apparatus operating at a relatively high speed to a second apparatus performing a time-divisional processing at a relatively low speed or long first period. The shift register operating at a second period shorter than the first period fetches data transmitted from the first apparatus with a designated time-divisional channel to which the data is to be assigned, stores the fetched data at a storage position corresponding to the designated channel and then outputs repetitively the stored data for each channel in turn at the second period. The latch latches the outputs from the shift register and outputs the latched data in synchronism with tile processing period of each channel in the second apparatus.

14 Claims, 7 Drawing Sheets

TIME-DIVISIONAL DATA REGISTER

This is a continuation of application Ser. No. 07/748,103 filed on Aug. 21, 1991, now abandoned.

BACKGROUND OF THE INVENTION

1. Field of the Invention

The present invention relates to a time-divisional register for temporarily storing data to be used in respective time-divisional channels when time-divisional processing is performed and, more particularly, to a time-divisional data register used for asynchronously transferring data from a first apparatus (e.g., a CPU) to a second apparatus (e.g., a sound source of an electronic musical instrument) for performing time-divisional processing at a relatively long period.

2. Description of the Prior Art

In a digital electronic musical instrument, the operations of the overall apparatus are controlled using a central processing unit (CPU). In this case, the CPU fetches data from respective operation members such as a keyboard, a pedal, and the like, and forms musical tone control data for controlling synthesis of tones on the basis of these operation member data. The CPU then transfers the formed data to a sound source. In order to allow polyphonic tone generation without complicating a circuit arrangement as much as possible, the sound source performs time-divisional processing with which a memory, an arithmetic circuit, and the like can be shared by a plurality of channels.

FIG. 7 shows a conventional time-divisional data register for transferring data such as tone control data from the CPU to the sound source in the electronic musical instrument. FIG. 4B shows operation timings of the respective sections of the register. The sound source executes 16-channel time-divisional processing at a 1-25-$\mu$s processing period $T_A$ for each channel, i.e., at a relatively long time-divisional period $T_D$ of 20 $\mu$s for 16 channels, so as to allow polyphonic tone generation of 16 tones.

In FIG. 7, a 16-stage shift register 1 is driven in response to a clock CLKA, and sequentially shifts data supplied to an input terminal IN and those stored in the respective stages to an output side at the period $T_A$. More specifically, data supplied to the input terminal IN is transmitted to an output terminal OUT with a delay of $16\times T_A$ ($=T_D$).

In FIG. 4B, a clock CLKA is a clock having the period $T_A$ (1.25 $\mu$s), and a clock CLKD is a clock having the period $T_D$ ($=16\times T_A=20$ $\mu$s).

In FIG. 7, a selector 2 is normally applied with an L-level signal at its select terminal SA, selects data DTA supplied to an input terminal B, and supplies the selected data to the input terminal IN of the shift register 1. More specifically, data written in the shift register 1 is normally circulated at the time-divisional period $T_D$, and tone forming data of corresponding channels are sequentially output in synchronism with the processing period $T_A$ of each time-divisional channel in the sound source.

When data DTA to be supplied to the sound source is to be rewritten, a CPU (not shown) supplies new data DATA, a number CH of a time-divisional channel whose data is to be rewritten with the new data, and an L-level write instruction signal R/W. The data DATA is supplied to a latch 3, the channel number CH is supplied to a channel timing coincidence detection circuit 4, and the write instruction signal R/W is supplied to an inverter 5. The write instruction signal R/W is set at L level since it designates a normal read mode at H level.

The latch 3 latches the data DATA in response to the leading edge of the clock CLKD. The channel timing coincidence detection circuit 4 comprises a channel counter (not shown) for counting the clock CLKA. When a channel number as a count value of the channel counter coincides with the channel number CH sent from the CPU, the circuit 4 outputs an H-level coincidence signal CT. FIG. 4B shows a case wherein the channel number CH designated by the CPU is 5.

The H-level coincidence signal CT is supplied to one input terminal of an AND gate 6. On the other hand, the other input terminal of the AND gate 6 receives an H-level signal obtained by inverting the L-level write instruction signal R/W by the inverter 5. Therefore, the output from the AND gate 6 goes to H level, and is supplied to the select terminal SA of the selector 2. Thus, the selector 2 selects the output data supplied from the latch 3 to its input terminal A, and supplies the selected data to the input terminal IN of the shift register 1. The respective stages of the shift register 1 fetch data at their input side in response to the leading edge of the clock CLKA. More specifically, data in first to 15th stages of the shift register 1 are shifted by one stage at a timing corresponding to the channel number CH (=5) designated by the CPU, and are stored in the second to 16th stages. At the same time, the data DATA latched by the latch 3 is written in the first stage of the shift register 1.

In this manner, in the conventional time-divisional data register, an access time for rewriting one data is equal to one time-divisional period $T_D$ ($=20\mu s$). More specifically, an apparatus which transfers data (e.g., a CPU) cannot execute next write processing until a timing corresponding to a channel to which data to be transferred of an apparatus which receives data (e.g., a sound source) is reached, and the data write processing is ended. For this reason, the CPU may have to wait for a maximum of $2\times T_D=40$ $\mu$s until one data is written in a given channel. In particular, when a plurality of data are to be written, a long time is undesirably required for write processing.

When, e. g., the CPU directly writes data in a plurality of channels without using the latch 3, if data are written in all the 16 channels, a total of a wait time until a timing corresponding to the first channel, and a write time requires a maximum of $2T_D$, and a long time is required for write processing again.

When a plurality of peripheral devices which perform time-divisional processing at different periods are connected, it is difficult to perform parallel data transfer between time peripheral devices and a first apparatus so as to shorten a processing time in the first apparatus.

SUMMARY OF THE INVENTION

It is an object of the present invention to provide a time-divisional data register and a method for asynchronously transferring data from a first apparatus such as a CPU to a second apparatus such as a sound source for performing time-divisional processing at a relative low speed, which register can shorten an access time from the first apparatus.

It is a second object of the present invention to provide a time-divisional data register and a method which, when a plurality of peripheral devices for performing time-divisional processing at different periods are connected, can adjust access times from the first apparatus, and hence, can perform parallel data transfer between the peripheral devices and the first apparatus so as to shorten a processing time.

In order to achieve the above objects, in a time-divisional data register and a method for asynchronously transferring data from a first apparatus to a second apparatus for performing time-divisional processing of a plurality of channels at a relatively long first period, data transmitted from the First apparatus is fetched and written to be temporarily stored in time-divisional data storage means at a relatively high speed, and thereafter, a processing period is converted to a low-speed period according to time-divisional processing.

According to the present Invention, after data from the first apparatus for transferring data is fetched and stored at a relatively high speed, the data is transferred at a timing matching with a time-divisional speed of the second apparatus for receiving data. Therefore, tile first apparatus does not require a long processing time for data write (transfer) processing.

The present invention preferably applied to an electronic musical instrument.

Since the write period of the first apparatus can be set to be different from the time-divisional period of the second apparatus, if a plurality of peripheral devices are connected, the access periods from the first apparatus to the respective peripheral devices can be set to be the same or to have a predetermined integer ratio. Therefore, since parallel accesses to the respective peripheral devices can be made by time division, a time required to access from the first apparatus to each peripheral device can be shortened.

DETAILED DESCRIPTION OF THE PREFERRED EMBODIMENT

An embodiment of the present invention will be described hereinafter with reference to the accompanying drawings.

Figure 1:
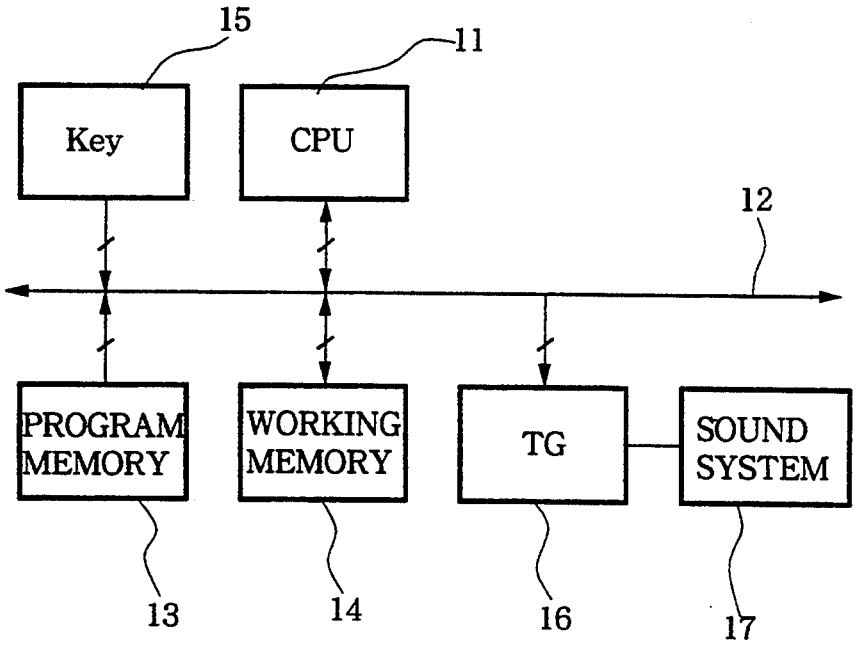
FIG. 1 is a block diagram showing the overall arrangement of an electronic musical instrument according to an embodiment of the present invention.

FIG. 1 is a block diagram showing the overall arrangement of an electronic musical instrument according to an embodiment of the present invention.

This electronic musical instrument controls the overall operations using a central processing unit (CPU) 11. The CPU 11 is connected, through a bidirectional bus line 12, a program memory 13 for storing a control program for the CPU 11, and various data necessary for generating tones, a working memory 14 for storing various data generated when the CPU 11 executes the control program, a key state detection circuit 15 for detecting key operations on a keyboard, and generating key code data KC representing an operated key, a key ON signal KON or a key OFF signal KOF representing an operation state of the operated key, key velocity data KV representing a key ON speed, and the like, and a sound source 16. The sound source 16 is connected to a sound system 17.

Figure 2:
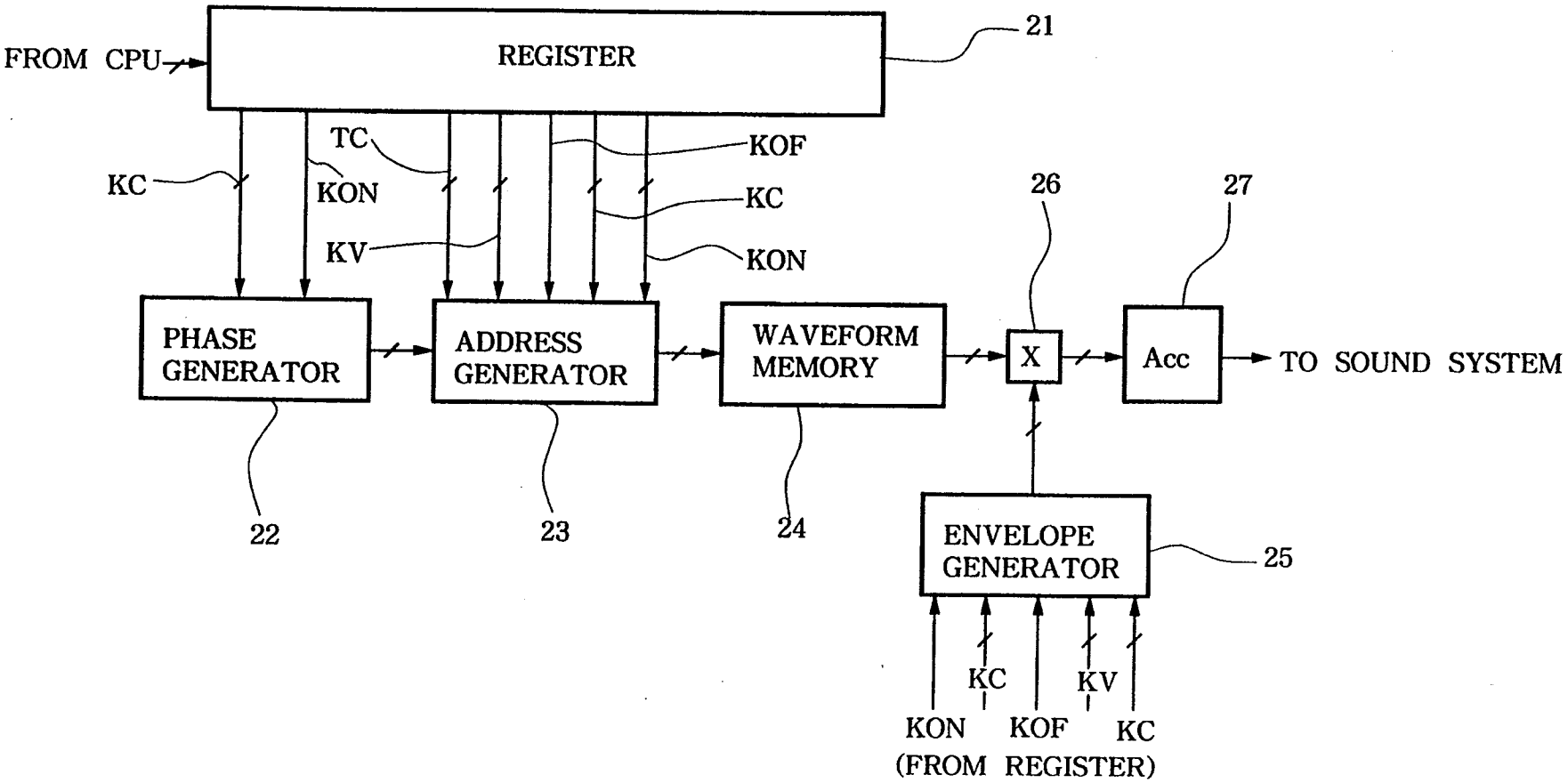
FIG. 2 is a block diagram showing in detail a sound source circuit shown in FIG. 1.

FIG. 2 shows in detail the sound source 16 shown in FIG. 1.

Figure 3:
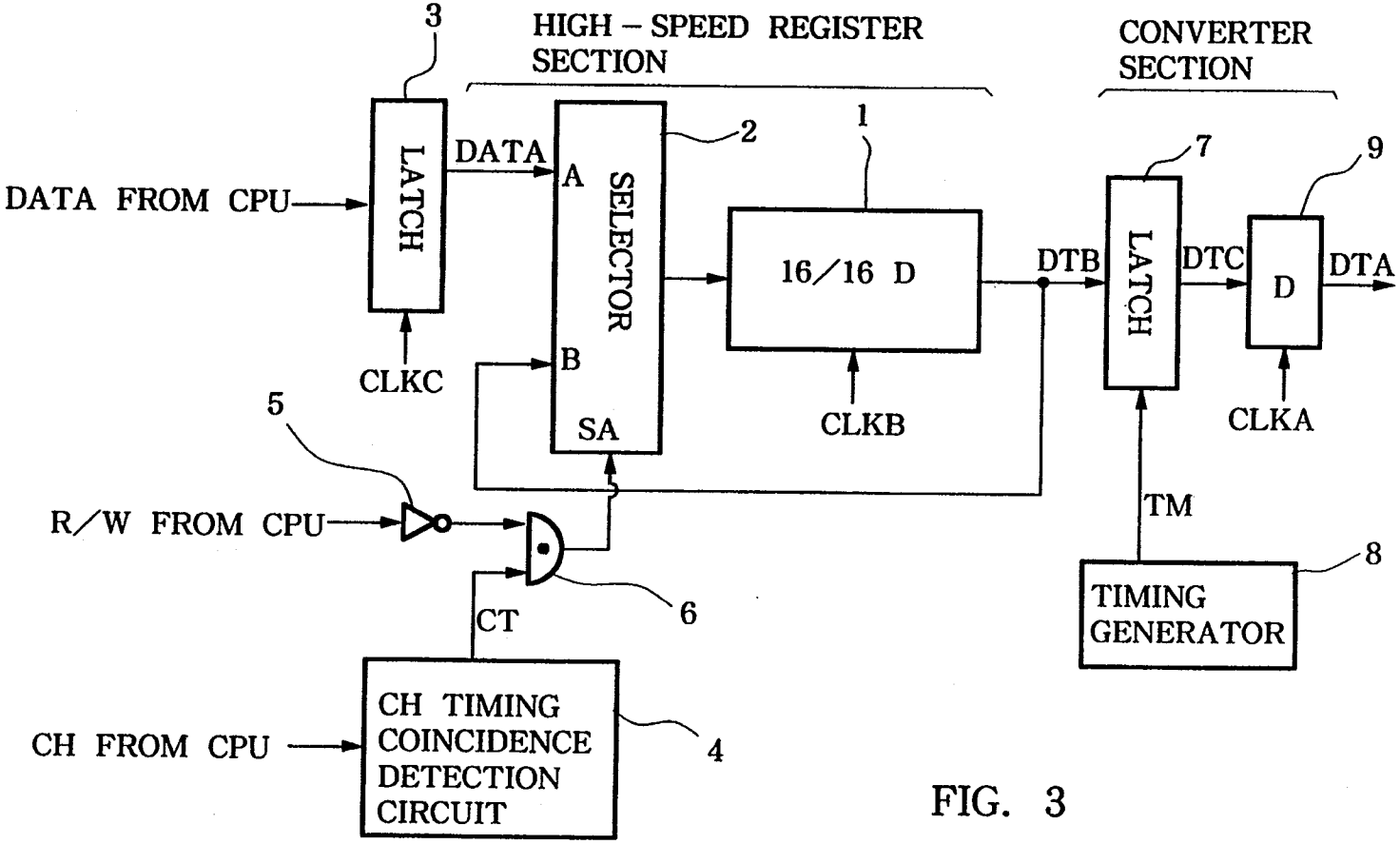
FIG. 3 is a block diagram showing in detail a time-divisional data register shown in FIG. 2.
Figure 7:
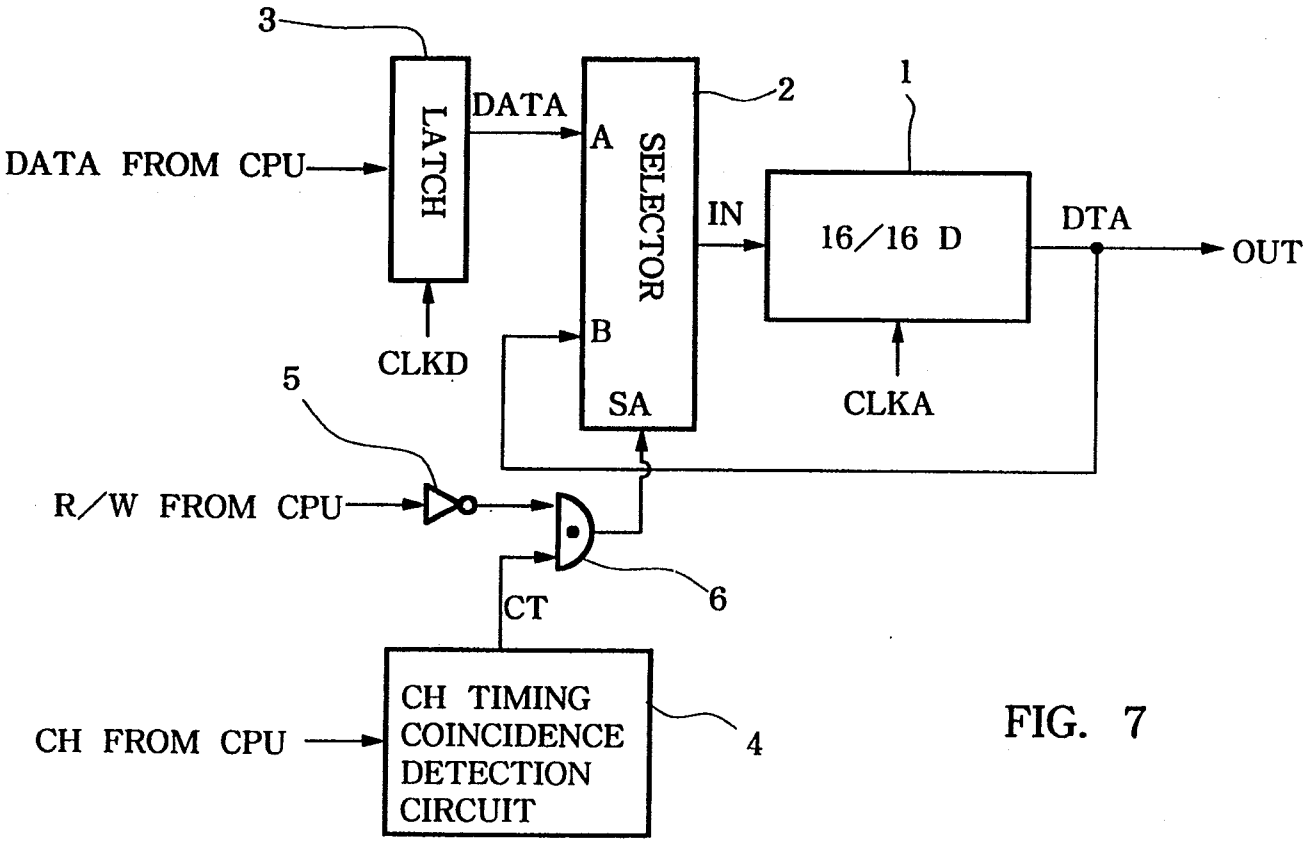
FIG. 7 is a block diagram showing an arrangement of the conventional time-divisional data register.

In the sound source shown in FIG. 2, a register of the conventional sound source shown in FIG. 7 is replaced with a register shown in FIG. 3 as a characteristic feature of the present invention.

In FIG. 2, a phase generator 22 receives key code data KC, and a key ON signal KON from the CPU 11 (FIG. 1) via a register 21, and determines phase data of a tone waveform to be generated in accordance with the key code data KC. The phase generator 22 generates the determined phase data in accordance with a transfer timing of the key ON signal KON.

An address generator 23 receives phase data IP from the phase generator 22, and also receives tone color data TC, key velocity data KV, a key OFF signal KOF, key code data KC, and a key ON signal KON from the CPU 11 via the register 21. The generator 23 generates an address for reading out tone waveform data from a waveform memory 24 on the basis of these data. In this case, the address generator 23 determines a storage area of tone waveform data in the waveform memory 24 on the basis of the tone color data TC, the key velocity data KV, and the key code KC, determines a read address in the determined storage area on the basis of the phase data IP, and starts generation of the address in response to the key ON signal KON. In addition, the tone waveform data is switched to a predetermined key OFF waveforth in response to the key OFF signal KOF.

An envelope generator 25 receives the same tone color data TC, key velocity data KV, key OFF signal KOF, key code data KC, and key ON signal KON as those received by the address generator 23 from the CPU 11 via the register 21, and generates envelope waveform data on the basis of these tone color data TC, key velocity data KV, and key code data KC. The key ON signal KON serves as a start signal for generation of envelope waveform data, i.e., a tone, and the key OFF signal KOF serves as a start signal of tone muting processing.

A multiplier 26 multiplies the tone waveform data supplied from the waveform memory 24 with the envelope waveform data supplied from the envelope generator 25, thus providing an envelope to the tone waveform.

An accumulator 27 adds 16 tone waveform data time-divisionally outputted through the multiplier 26. Thus, 16 tones are acoustically mixed. Output data from the accumulator 27 is supplied to the sound system 17 (FIG. 1).

The sound system 17 comprises a D/A converter, an amplifier, a loudspeaker, and the like (not shown). The sound system 17 converts the output data from the accumulator 27 into an analog signal, and amplifies the analog signal, thereby driving the loudspeaker. Thus, a mixed tone of tones formed by the 16 time-divisional channels of the sound source 16 is produced from the loudspeaker as an acoustic tone.

Figure 4A:
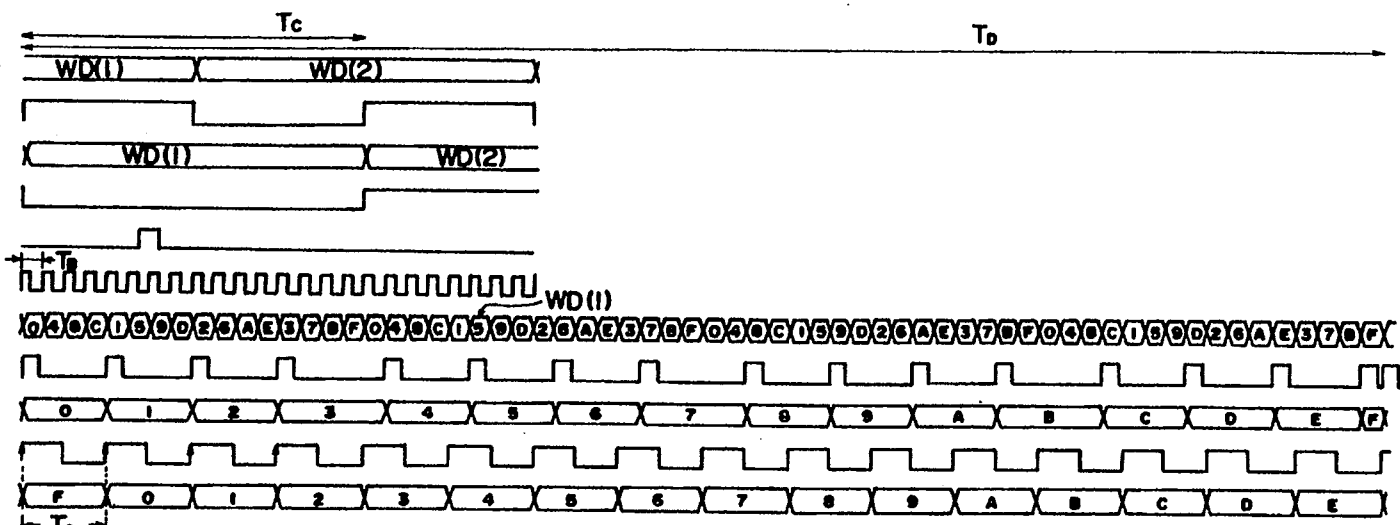
FIG. 4A is a timing chart of operations of the respective sections of the time-divisional data register shown in FIG. 3.
Figure 4B:
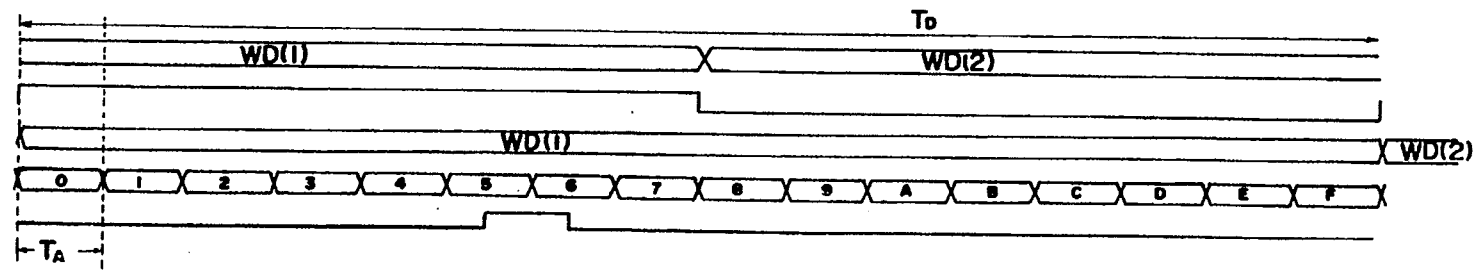
FIG. 4B is a timing chart of operations of respective sections of a conventional time-divisional data register shown in FIG. 7.

FIG. 3 shows in detail the register 21 in FIG. 2, and FIG. 4A shows timings of operations of the respective sections of the register shown in FIG. 3.

The register shown in FIG. 3 uses, as clocks for driving a shift register 1 and a latch 3, high-speed clocks CLKB and CLKC whose periods are $\frac{1}{4}$ those of the clocks CLKA and CLKD in the prior art shown in FIG. 7, and is constituted by adding, to the period art shown in FIG. 7, a latch 7 for latching transfer data, at a period closer to the time-divisional processing prior $T_A$ of the sound source, sequentially outputted from the shift register 1 in correspondence with the respective time-divisional channels at a period $T_B$ (=0.3125 μs) of the clock CLKB, a timing generator 8 for generating a clock TM for fetching transfer data, and a delay circuit 9 for fetching the output from the latch 7 in response to the leading edge of the clock CLKA having the period $T_A$ (=1.25 μs), and holding the fetched data for one period defined between the leading edges of the two adjacent clocks CLKA.

In the register shown in FIG. 3, write processing of data from the CPU 11 (FIG. 1), and data circulating processing in the shift register 1 and a selector 2 are performed in substantially the same manner as in the prior art except that these processing operations are performed at a high speed four times those in the prior art since the clocks CLKB and CLKC are faster by four times than the conventional clocks CLKA and CLKD. Note that data are arranged in the shift register 1 in the order of channels 0, 4, 8, C, 1, 5, 9, D, 2, 6, A, E, 3, 7, B, and F in hexadecimal notation, as shown in FIG. 4A, so that data can be sequentially outputted from the delay circuit 9 in the order from the channel 0 to the channel 15 (F in hexadecimal notation). On the other hand, data may be arranged in the shift register 1 in the order of channels 0 to F. In this case, time-divisional processing in the sound source is executed in the order of channels 0, 4, 8, . . . , B, and F. In the following description, the channel number CH is expressed by hexadecimal notation.

In the register shown in FIG. 3, read processing is executed every four clocks CLKB in principle. In this case, however, data of only four channels of the 16 channels are repetitively read out. Thus, as shown in FIG. 4A, the read clock TM is delayed by one clock CLKB (one channel) every time data of four channels are read out. After data for the 16 channels are read out, a delay time of three clocks caused by reading out data for the 16 channels are restored.

Figure 5:
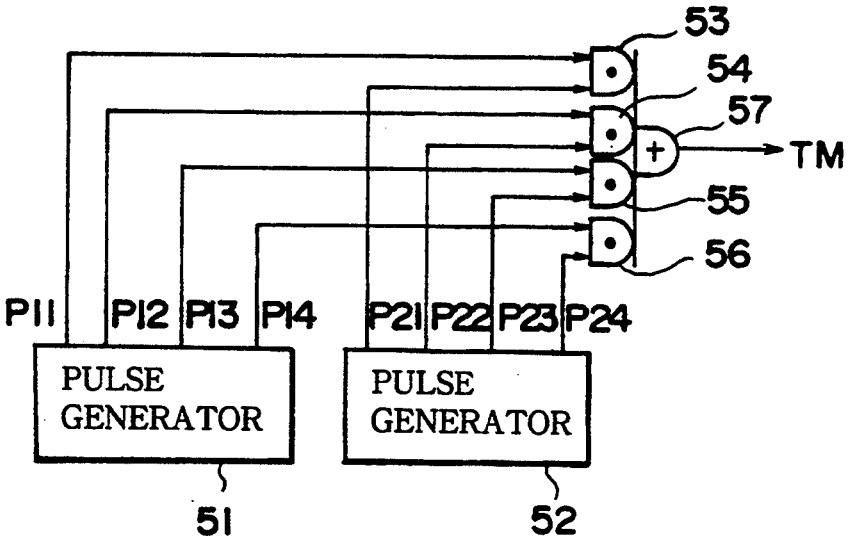
FIG. 5 is a block diagram showing in detail a timing generator shown in FIG. 3.

FIG. 5 shows an arrangement of the timing generator for generating the read clock TM.

Figure 6:
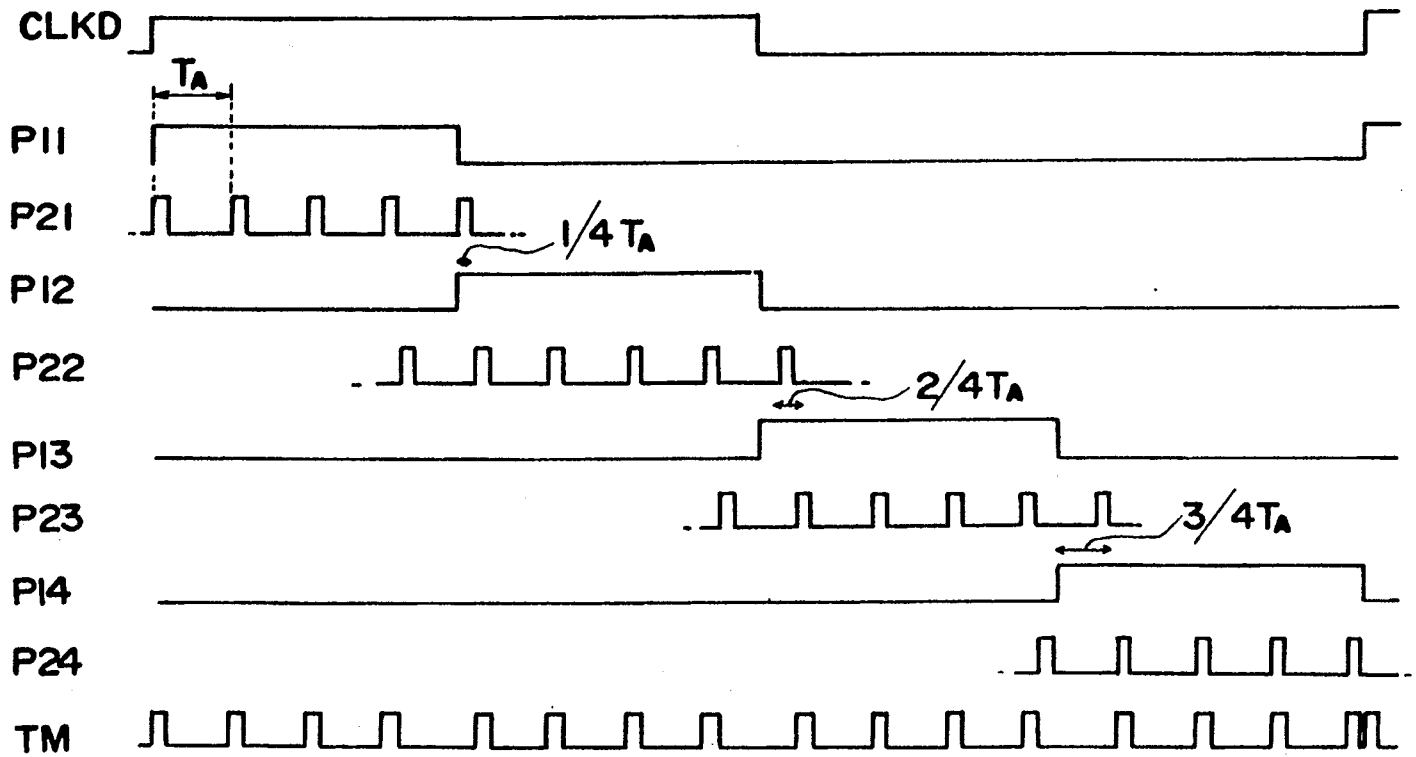
FIG. 6 is a timing chart showing operations of respective sections in the timing generator shown in FIG. 5.

In FIG. 5, a pulse generator 51 generates pulses P11, P12, P13, and P14 which go to H level in turn for a $\frac{1}{2}$ period of the clock CLKD, as shown in FIG. 6.

As shown in FIG. 6, a pulse generator 52 generates pulses P21 which have the period $T_A$ of the clock CLKA, whose width is slightly narrower than $\frac{1}{2}$-$T_A$, and whose leading edges are synchronous with the pulses P11 to P14. The generator 52 also generates pulses P22, P23, and P24 whose phases are sequentially shifted by one period $T_B$ of the clock CLKB from the pulses P21.

An AND gate 53 outputs four pulses P21 having a phase delay of 0 while the pulse P11 corresponding to the first $\frac{1}{4}$ period of the clock CLKD is at H level. AND gates 54 to 56 output four pulses P22 to P24 each respectively having phase delays of $1T_B$ to $3T_B$ while the pulses P12 to P14 corresponding to the second to fourth $\frac{1}{4}$ periods of the clock CLKD are at H level.

The outputs from these AND gates 53 to 56 are mixed by an OR gate 57, thereby obtaining the timing pulse TM, as shown in FIG. 4A. The phase of the timing pulse TM is slightly delayed from the clock CLKA.

Referring back to FIG. 3, the latch 7 fetches output data DTB from the shift register 1 in response to the leading edge of the pulse TM outputted from the timing generator 8, and outputs it as latched data DTC.

The delay circuit 9 fetches the output data DTC from the latch 7 in response to the leading edge of the clock CLKA, and outputs it as data DTA in response to the leading edge of the next clock CLKA. The output data DTA is held until it is updated with data for the next channel at the leading ledge of the next clock CLKA.

As described above, in the register shown in FIG. 3, data DATA from the CPU 11 (FIG. 1) can be written at a period $T_C$ $\frac{1}{4}$ the conventional period $T_D$, and data can be supplied to the sound source 16 (FIG. 1) at the period $T_A$ as an original time-divisional speed of the sound source. More specifically, the data write processing speed of the CPU 11 can be increased four times without modifying the sound source 16 except for the register 21.

Modification of the Embodiment

The present invention is not limited to the above embodiment, and may be properly modified.

For example, in the above embodiment, the ratio of a write speed from the CPU to a time-divisional processing speed in the sound source is set to be 4. However, this speed ratio may be arbitrarily set. In particular, if the speed ratio is set to be other than an integer multiple of the number of time-divisional channels or the number of stages of the shift register, one of the latch 7 and the delay circuit 9, and the timing generator 8 can be omitted. When the latch 7 is left, the clock CLKA is used as a latch signal for the latch 7.

A data arrangement in the shift register 1 may be set in the order of 0, D, A, 7, 4, 1, E, B, 8, 5, 2, F, C, 9, 6, and 3 when the speed ratio=5; 0, 7, E, 5, C, 3, A, 1, 8, F, 6, D, 4, B, 2, and 9 when the speed ratio =7; F, E, D, . . . , 2, 1, and 0 when the speed ratio =15; and 0, 1, 2, . . . , D, E, and F when the speed ratio =17.

What is claimed is:

1. A time-divisional data register for temporarily storing data transmitted from a central processing unit for controlling generation of musical tone signals and transferring the stored data to a sound source having a plurality of channels for respectively generating musical tone signals, for performing time-divisional processing of a plurality of channels at a first rate having a first period, comprising:

channel designation means for designating at least one of the plurality of channels;

storage means for storing, at a second rate having a second period shorter than the first period, data transmitted from the central processing unit asynchronously with the processing of the plurality of channels, the storage means storing the data at a storage position corresponding to the designated channel and circulatively repetitively outputting the stored data at the second rate; and latch means for latching the data output from said storage means in synchronism with the processing of the plurality of channels in the sound source, and outputting the latched data to the sound source in the channel processing order of the sound source.

2. A time-divisional register according to claim 1, wherein the storage means comprises a circulation register in which the data for each channel is handed down from one data-storage position to the next to so that the data for the respective channels are circulatively stored.

3. A time-divisional register according to claim 2, wherein the data-storage positions for respective channels are arranged in a predetermined order different from a regular order which is the channel processing order of the sound source and data from the CPU is stored in a position corresponding to a channel designated by the CPU.

4. A method for asynchronously transferring time-divisional data from a central processing unit for controlling generation of musical tone signals to a sound source having a plurality of channels for respectively generating musical tone signals, for performing time-divisional processing of a plurality of channels at a relatively long first period, comprising the steps of:

fetching, at a second period shorter than the first period, data transmitted from the central processing unit while a predetermined time-divisional channel is designated;

storing the fetched data at a position corresponding to the designated channel;

outputting, circulatively repetively, the stored data at the second period;

latching the output data in synchronism with the processing of the plurality of channels in the sound source; and outputting the latched data to the sound source.

5. An electronic musical instrument comprising:

a central processing unit for processing and transmitting data to control generation of a musical tone signal;

a sound source having a plurality of channels for respectively generating musical tones, for performing time-divisional processing at a rate having a first period; and a time-divisional data register for transferring the data transmitted from the central processing unit asynchronously with the time-divisional processing to the sound source, the time-divisional data register including storage means for storing, at a second rate having a period shorter than the first period, the data transmitted from said central processing unit at a storage position corresponding to at least one designated channel, and for circulatively repetitively outputting the data at the second rate, and latch means for latching the data output from said storage means in synchronism with the processing of the plurality of channels in the sound source and for outputting the latched data to the sound source.

6. An electronic musical instrument for performing data-processing at a plurality of speeds, comprising:

first means for processing data at a first speed and transmitting the data;

second means having a plurality of channels for respectively processing the transmitted data on a time-divisional basis at a second speed;

shift register means having a plurality of storing areas corresponding to the plurality of channels for storing the data transmitted asynchronously with the processing of the plurality of channels by the first means, at a third speed which is a shifting speed of the shift register means and faster than the second speed;

selecting means, coupled to the first means and the shift register means, for selecting at least one of data transmitted by the first means and data outputted by the shift register means and for outputting the selected data to the shift register means; and latch means, coupled to the shift register means, for latching the data output by the shift register means and for transmitting the latched data to the plurality of channels at a predetermined period corresponding to the second speed in the channel processing order of the second means.

7. An electronic musical instrument according to claim 6, wherein the first means comprises a central processing unit and the second means comprises a sound source having a plurality of channels which respectively generate a plurality of musical tones.

8. An electronic musical instrument according to claim 6 further comprising timing generating means coupled to the latch means for generating a latch signal, wherein the latching means latches the output data based on the latch signal.

9. An electronic musical instrument according to claim 6, wherein the third speed is N times as fast as the second speed and the second means includes at least M channels, the plurality of storing areas respectively corresponding to the plurality of channels being arranged so that the data respectively corresponding to the plurality of channels is put in a predetermined order where the corresponding data forms a line having intervals of N in turn, and wherein N and M are natural numbers.

10. An electrical musical instrument for performing data processing at a plurality of speeds asynchronous from each other comprising:

a central processing unit for processing data at a first speed;

a sound source having a plurality of channels which respectively process data at a second speed on a time-divisional basis, wherein the first speed is N times as fast as the second speed, N being a natural number;

data transmitting means coupled to the central processing unit and the sound source for transmitting the data processed by the central processing unit and respectively corresponding to the plurality of channels to the sound source in a predetermined order, wherein the corresponding data forms a line at intervals of N, such that the sound source can receive the transmitted data in an order corresponding to an arrangement of the plurality of channels.

11. An electronic musical instrument according to claim 10, wherein the data transmitting means includes a shift register having a plurality of data storage areas corresponding to the plurality of channels, the data output by the central processing unit being transmitted into the shift register at the first speed, and latching means for latching the data output by the shift register at the second speed.

12. A time-divisional data register for temporarily storing data transmitted from a central processing unit for controlling generation of musical tone signals and transferring the stored data to a sound source having a plurality of channels for respectively generating musical tone signals, the sound source processing on a time-divisional basis a plurality of channels at a first rate, the register comprising:

a channel designator that designates at least one of the plurality of channels;

a multi-stage memory having a second rate asychronous of and faster than the first rate that stores data transmitted from the central processing unit upon designation from a channel designation signal and recirculates data from the last stage of the memory to the first of the memory in the absence of the channel designation signal;

a latch coupled to the last stage of the memory, the latch latching at the first rate in synchronism with the sound source.

13. An electronic musical instrument comprising:

a first apparatus that transmits musical tone generation data at a first rate;

a second apparatus having a plurality of channels, the second apparatus performing time-divisional processing of the channels at a second rate asynchronous from the first rate;

a channel designator that generates a channel designation designating tone generation data transmitted by the first apparatus for a channel of the second apparatus;

a compensating data register that transfers the data transmitted from the first apparatus to the second apparatus, the register including a memory that stores, at a third rate faster than the second rate, the data transmitted from the first apparatus at a storage position according to the channel designation, and that circulatively repetitively outputs the stored data at the third rate, and a latch coupled to the output of the memory in synchronism with the second apparatus at the second rate.

14. An electronic musical instrument for performing data-processing at a plurality of speeds, comprising:

a first apparatus that processes data at a first speed and transmits the data;

a second apparatus having a plurality of channels, the channels respectively processing the transmitted data on a time-divisional basis at a second speed;

a shift register having a plurality of storage areas corresponding to the plurality of channels, the shift register storing the data transmitted asynchronously with the processing of the plurality of channels by the first apparatus, at a third speed which is a shifting speed of the shift register and faster than the second speed;

a selector coupled to the first apparatus and the shift register that selects at least one of data transmitted by the first apparatus and data outputted by the shift register and outputs the selected data to the shift register; and a latch coupled to the shift register that latches the data output by the shift register and transmits the latched data to the plurality of channels at a predetermined period corresponding to the second speed in the channel processing order of the second apparatus.

* * * * *